US008322179B2

(12) United States Patent
Grieshofer et al.

(10) Patent No.: US 8,322,179 B2
(45) Date of Patent: Dec. 4, 2012

(54) REEL FURNACE HAVING A STRIP REELING DEVICE

(75) Inventors: Oliver Grieshofer, Allhaming (AT); Herbert Hinterleitner, Linz (AT); Michael Jesche, Mödling (AT); Thomas Kierner, Andorf (AT); Friedrich Moser, Hellmonsödt (AT); Wolfgang Peitl, St. Florian (AT); Guenter Thaller, Reith (AT); Peter Wimmer, Wolfern (AT)

(73) Assignee: Siemens Vai Metals Technologies GmbH (AT)

( * ) Notice: Subject to any disclaimer, the term of this patent is extended or adjusted under 35 U.S.C. 154(b) by 1135 days.

(21) Appl. No.: 12/090,180

(22) PCT Filed: Oct. 5, 2006

(86) PCT No.: PCT/EP2006/009633

§ 371 (c)(1),
(2), (4) Date: May 28, 2008

(87) PCT Pub. No.: WO2007/045359

PCT Pub. Date: Apr. 26, 2007

(65) Prior Publication Data

US 2008/0245918 A1 Oct. 9, 2008

(30) Foreign Application Priority Data

Oct. 18, 2005 (AT) ..... A 1705/05

(51) Int. Cl.
*B21B 27/06* (2006.01)
*B21C 47/00* (2006.01)

(52) U.S. Cl. ..... 72/202; 72/200; 72/148

(58) Field of Classification Search ..... 72/202, 72/200, 229, 148
See application file for complete search history.

(56) References Cited

U.S. PATENT DOCUMENTS 2,646,231 A * 7/1953 Frielinghaus ..... 72/148
(Continued)

FOREIGN PATENT DOCUMENTS

AT 503 109 8/2007
(Continued)

OTHER PUBLICATIONS

Machine translation of Matsuda JP 10076315.*

(Continued)

*Primary Examiner* — Dana Ross
*Assistant Examiner* — Mohammad I Yusuf
(74) *Attorney, Agent, or Firm* — Ostrolenk Faber LLP

(57) ABSTRACT

In a reel furnace having a strip reeling device, the strip reeling device comprising a reel shaft, a reel drum supported on the reel shaft and at least one stirrup clamp, the reel shaft passing through a furnace wall delimiting the inner space of the reel furnace and being supported rotatably in supporting bearings outside the reel furnace, the reel drum and the at least one stirrup clamp being positioned with respect to one another by means of a connection element, and a gap for receiving a strip head being set between the reel drum and the at least one stirrup clamp. The useful life of the reel drum is appreciably increased and a strip thickness-dependent setting of the entry gap for the hot-rolled strip is ensured when the reel drum is designed as a closed body and the connection element is designed as an actuating device for fixing a specific gap width between the reel drum and the stirrup clamp and for clamping a strip head which has entered the gap.

15 Claims, 6 Drawing Sheets

U.S. PATENT DOCUMENTS

| | | | | |
|---|---|---|---|---|
| 3,003,713 | A | 10/1961 | King | |
| 4,442,690 | A * | 4/1984 | Hirschmanner et al. | 72/202 |
| 5,479,807 | A | 1/1996 | Moser | |
| 5,498,156 | A | 3/1996 | Smith | |
| 5,848,543 | A | 12/1998 | White | |
| 2004/0261484 | A1 * | 12/2004 | Dommel et al. | 72/202 |
| 2008/0245918 | A1 | 10/2008 | Grieshofer | |

FOREIGN PATENT DOCUMENTS

| | | | |
|---|---|---|---|
| DE | 909577 | C | 4/1954 |
| DE | 948603 | | 9/1956 |
| DE | 948603 | A | 9/1956 |
| DE | 1181 152 | | 11/1964 |
| DE | 1265102 | B | 4/1968 |
| DE | 2110317 | A1 | 9/1972 |
| DE | 10333004 | A1 | 4/2004 |
| EP | 0619377 | A1 | 10/1994 |
| GB | 693397 | A | 7/1953 |
| JP | 1034235 | | 3/1989 |
| JP | 10034235 | A | 2/1998 |
| JP | 10-76315 | | 3/1998 |
| JP | 10076315 | * | 3/1998 |
| JP | 2005-511315 | | 4/2005 |
| RU | 2101112 | C1 | 1/1998 |
| SU | 2228229 | C2 | 11/1964 |
| UA | 75750 | C2 | 12/2005 |
| WO | WO 03/048397 | | 6/2003 |
| WO | WO 2007/045359 | | 4/2007 |

OTHER PUBLICATIONS

International Search Report dated Feb. 1, 2007 issued in corresponding PCT Application No. PCT/EP2006/009633.

Office Action dated Jul. 12, 2011 issued in corresponding Japanese Patent Application No. 2008-535927 (3 pages).

* cited by examiner

REEL FURNACE HAVING A STRIP REELING DEVICE

CROSS REFERENCE TO RELATED APPLICATION

The present application is a 35 U.S.C. §§371 national phase conversion of PCT/EP2006/009633, filed Oct. 5, 2006, which claims priority of Austrian Application No. A1705/05, filed Oct. 18, 2005. The PCT International Application was published in the German language.

BACKGROUND OF THE INVENTION

The invention relates to a reel furnace having a strip reeling device. The strip reeling device comprises a reel shaft, a reel drum supported on the reel shaft and at least one stirrup clamp. The reel shaft passes through a furnace wall delimiting the inner space of the reel furnace and is supported rotatably in supporting bearings outside the reel furnace. The reel drum and the at least one stirrup clamp are positioned with respect to one another by means of a connection element, and a gap for receiving a strip head is set between the reel drum and the at least one stirrup clamp.

Strip reeling devices of this type are employed preferably in conjunction with Steckel rolling mills for the winding, intermediate storage and unwinding of hot-rolled strip-shaped stock between successive rolling passes.

Steckel drums usually have a hollow-cylindrical drum body with a longitudinal slot which is coordinated with the maximum rolled strip width. The cylindrical drum body forms with its surface area the winding surface for the first strip turn, and the longitudinal slot forms an entry orifice for the strip head of the hot-rolled strip. Owing to the slot, there is an open cross section of the drum body which has a greatly reduced torsional moment of resistance, as compared with a closed cross section. This weakening of the drum body leads, during the period of use of the drum, to flattening of its circular geometry, varies the slot geometry and additionally gives rise, during winding, to strip tension fluctuations which have an adverse effect on the stability of the winding operation. Further, high local notch stresses in the drum casing arise at both slot ends. These stress patterns, the tendency to deformation and the influence of the high operating temperature curtail seriously the useful life of the Steckel drum, and therefore even after a production quantity of about 500 000 tons of hot-rolled strip, a drum change becomes necessary.

Reel furnaces having a strip reeling device of the type initially described are already known from DE-A 909 577, DE 21 10 317 A1 and GB-A 693 397. The reel drum in each case comprises a middle part, which is pushed on a reel shaft, and two drum segments mounted tiltably in lateral plates. A wedge-shaped reception orifice for the entering strip head of a hot-rolled strip is formed by the middle part and each of the drum segments. Immediately after the entry of the hot-rolled strip, the reel drum begins to rotate and winds up the hot-rolled strip. None of these known embodiments affords the possibility of an individual setting of the gap width as a function of the strip thickness of the entering hot-rolled strip and also of a defined clamping of the hot-rolled strip.

The multipart setup of a reel drum under axial spring tension, such as is known in a strip reeling device according to DE 21 10 317 A1, requires a complicated system of bosses, which, emanating from fixed stirrup elements, project into recesses of the individual reel drum elements and act as drivers, but at the same time also at least partially as stops for the entering hot-rolled strip. Even DE 21 10 317 A1 points to the high susceptibility to wear of these bosses and of the reel shaft elements which have to be equipped with particularly hard and wear-resistant coverings. Constructions of this type cannot be used efficiently under thermal loads of 800° C. to 1000° C.

SUMMARY OF THE INVENTION

The object of the present invention, therefore, is to avoid the disadvantages of the known prior art and to propose a reel furnace having a strip reeling device, in which the useful life of the reel drum is appreciably increased by means of structural measures. Further, a strip thickness-dependent setting of the entry gap for the hot-rolled strip is to be ensured and strip tension fluctuations are to be largely minimized.

Proceeding from a device of the type initially described, this object is achieved in that the reel drum is designed as a closed body and the connection element determining the radial position of the stirrup clamp with respect to the reel drum is designed as an actuating device for fixing a specific gap width between the reel drum and the stirrup clamp and for clamping a strip head which has entered the gap. Configuring the reel drum as a closed hollow body fastened on the reel shaft, in particular without a longitudinal slot in the drum casing and without any other kind of division and segmenting of the drum casing, increases the useful life of the reel drum most appreciably.

In order in particular to keep movable parts of the actuating device away from high thermal actions, according to an advantageous embodiment, it is proposed that the reel shaft and the stirrup clamp pass through a furnace wall delimiting the inner space of the reel furnace, and that the actuating device be arranged outside the inner space of the reel furnace. Preferably, the actuating device is arranged fixedly in terms of rotation on the reel shaft, and the stirrup clamp is secured to the actuating device so as to be relatively movable with respect to the reel shaft.

To minimize heat losses in the passage region of the reel shaft and the stirrup clamp, co-rotating eccentrically with respect to the axis of rotation of the reel shaft, through the furnace wall, it is expedient if the furnace wall is designed in the passage region of the reel shaft and the stirrup clamp as a disk co-rotating with the reel shaft. The largely leaktight transition from the rotating disk to the stationary furnace wall takes place by means of a seal consisting of a heat-resistant sealing material, preferably a seal similar to a heat-resistant concertina.

Expediently, according to a first possible embodiment, the actuating device comprises a carrying frame which is fastened fixedly in terms of rotation to the drum shaft and to which are assigned guides, on which a link carrying the stirrup clamp and having counterstays is guided. The guides and counterstays are designed such that they allow a relative movement varying the gap width of the gap between the stirrup clamp and the reel drum. The guides on the carrying frame and the counterstays on the link are in this case oriented radially with respect to the axis of rotation of the reel shaft.

An indirect fastening of the carrying frame on the reel shaft is also possible, in that the carrying frame is fastened to the disk, co-rotating with the reel shaft, of the furnace wall or is integrated directly into the co-rotating disk of the furnace wall.

According to a preferred embodiment of the invention, the actuating device comprises an adjusting frame with guides and a link which is relatively movable with respect to this and carries the stirrup clamp and which has counterstays, the adjusting frame being supported displaceably on a fixed supporting structure, and an actuating member, preferably a hydraulic pressure medium cylinder, engaging on the adjusting frame and, in turn, being supported on the fixed supporting structure.

A jam-free transmission of an actuating force or actuating movement applied by the actuating member is convertible by simple means into a radially acting clamping force or a gap-width setting force or actuating movement of the stirrup clamp, in that the adjusting frame is supported on the fixed supporting structure so as to be relatively movable parallel to the axis of rotation of the reel shaft and is acted upon by the actuating member, and the guides on the adjusting frame and the counterstays on the link are oriented at an angle to the axis of rotation of the reel shaft.

According to a further possible embodiment of the invention, the actuating device comprises a carrying frame connected fixedly in terms of rotation to the reel shaft, the carrying frame being assigned a pivot axis oriented parallel to the axis of rotation of the reel shaft, and there being arranged pivotably on this pivot axis a pivoting mechanism which is coupled along one of its extents to the stirrup clamp and along another of its extents to an actuating member which is supported on the carrying frame.

If the pivoting mechanism is formed by a two-armed lever, in the setting of a gap for the strip head of the hot-rolled strip a pivoting movement of the stirrup clamp in relation to the reel shaft takes place through a small angle which gives rise to a slight, but insignificant wedge formation of the gap.

If the pivoting mechanism comprises a parallel link arrangement for tying up the stirrup clamp, the setting of a gap with a constant gap width for receiving the strip head takes place by means of a parallel displacement of the stirrup clamp in relation to the reel shaft.

The actuating device comprises an actuating member which is preferably formed by a hydraulic pressure medium cylinder and to which is assigned a control block incorporated into the plant control loop of the reel furnace and of the rolling mill plant.

A reel furnace having a strip reeling device of the type according to the invention which is arranged in the inner space of the reel furnace is preferably used in the reversing hotrolling of a metal strip, preferably of a steel strip. Hot rolling in this case takes place in a plurality of successive passes, in reversing rolling mills, preferably such as a Steckel rolling mill.

Further advantages and features of the present invention may be gathered from the following description of unrestrictive exemplary embodiments, reference being made to the accompanying figures in which:

BRIEF DESCRIPTION OF THE DRAWINGS

FIG. 1 shows, in a diagrammatic illustration, a vertical section through a reel furnace having a strip reeling device along the axis of rotation of a reel shaft. A reel furnace of this type having a strip reeling device is used for the winding, storage and unwinding of hot-rolled steel strip in a reversing rolling mill plant.

Figure 1:
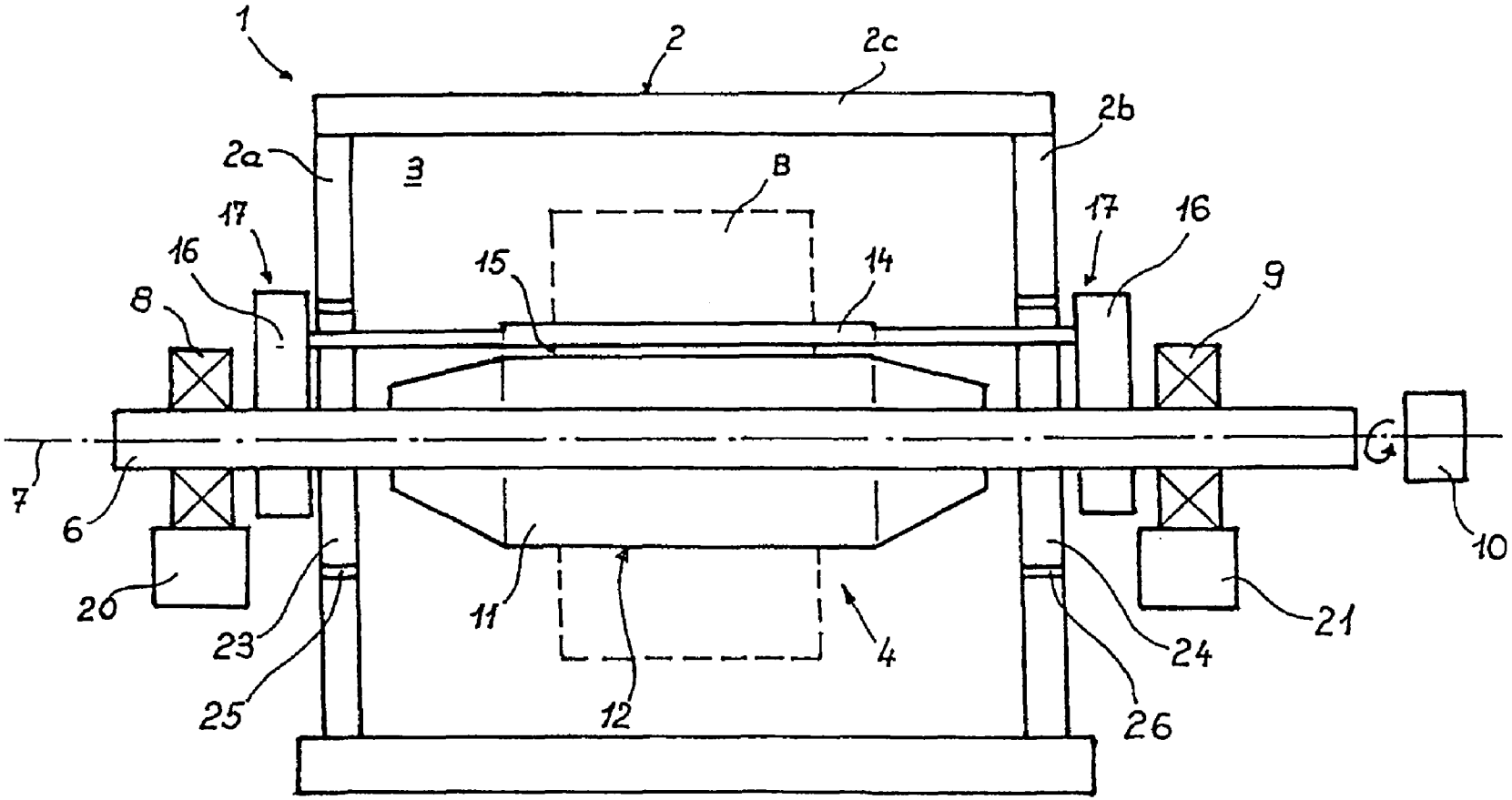
FIG. 1 shows a longitudinal section through the reel furnace according to the invention having a strip reeling device according to the invention.

The reel furnace 1 consists of a largely closed furnace housing 2 formed by a plurality of furnace walls 2*a*, 2*b*, 2*c* provided with a heat-insulating lining. Essential components of the strip reeling device 4 are located in the inner space 3 of the reel furnace, the space temperature of which can be set in a regulable way.

A reel shaft 6 is arranged rotatably about an axis of rotation 7. The reel shaft 6 passes through the lateral furnace walls 2*a*, 2*b* and is mounted in supporting bearings 8, 9 in a region, not subjected to thermal load, outside the furnace housing 2.

The reel shaft 6 is coupled to a regulable rotary drive 10. The reel drum 11 is shaped as a hollow body with a continuously closed cylindrical surface area 12 and is positioned fixedly in terms of rotation on the reel shaft 6. A stirrup clamp 14, which is arranged at a radial distance from the surface area 12 of the reel drum 11 and extends along this, forms a gap 15 with respect to the surface area of the reel drum. In a cross section perpendicular to the axis of rotation 7 of the reel shaft, the reel drum 11 and the stirrup clamp 14 form a common outer contour which corresponds approximately to a circular shape, thus ensuring a sufficient true running of the strip reeling device.

The gap 15 formed by the reel drum 11 and the stirrup clamp 14 receives the strip head of a hot-rolled strip entering the reel furnace, immediately starts with the rotational movement of the strip reeling device, clamps the hot-rolled strip between the reel drum and the stirrup clamp and winds the hot-rolled strip into the coil B indicated by dashed and dotted lines.

The stirrup clamp 14 likewise extends in the direction of the axis of rotation 7 through the furnace walls 2*a*, 2*b* and is fixed in its relative position with respect to the reel drum 11 outside the furnace housing 2 by means of a connection element 16 which fulfills the functions of the actuating device 17. In the passage region of the reel shaft 6 and of the stirrup clamp 14 through the furnace walls 2*a*, 2*b*, these furnace walls are formed by disks 23, 24 co-rotating with the reel shaft and the stirrup clamp. These disks are connected fixedly in terms of rotation to the reel shaft 6 and are sealed off with respect to the adjoining stationary furnace walls 2*a*, 2*b* by means of sealing elements 25, 26, for example seals in the manner of a heat-resistant concertina, so that the ingress of ambient air into the hot inner space of the reel furnace and consequently a local cooling of the hot-rolled strip are reliably avoided.

The supporting bearings 8, 9 are supported on stationary carrying frames 20, 21 on both sides of the furnace housing.

Figure 2:
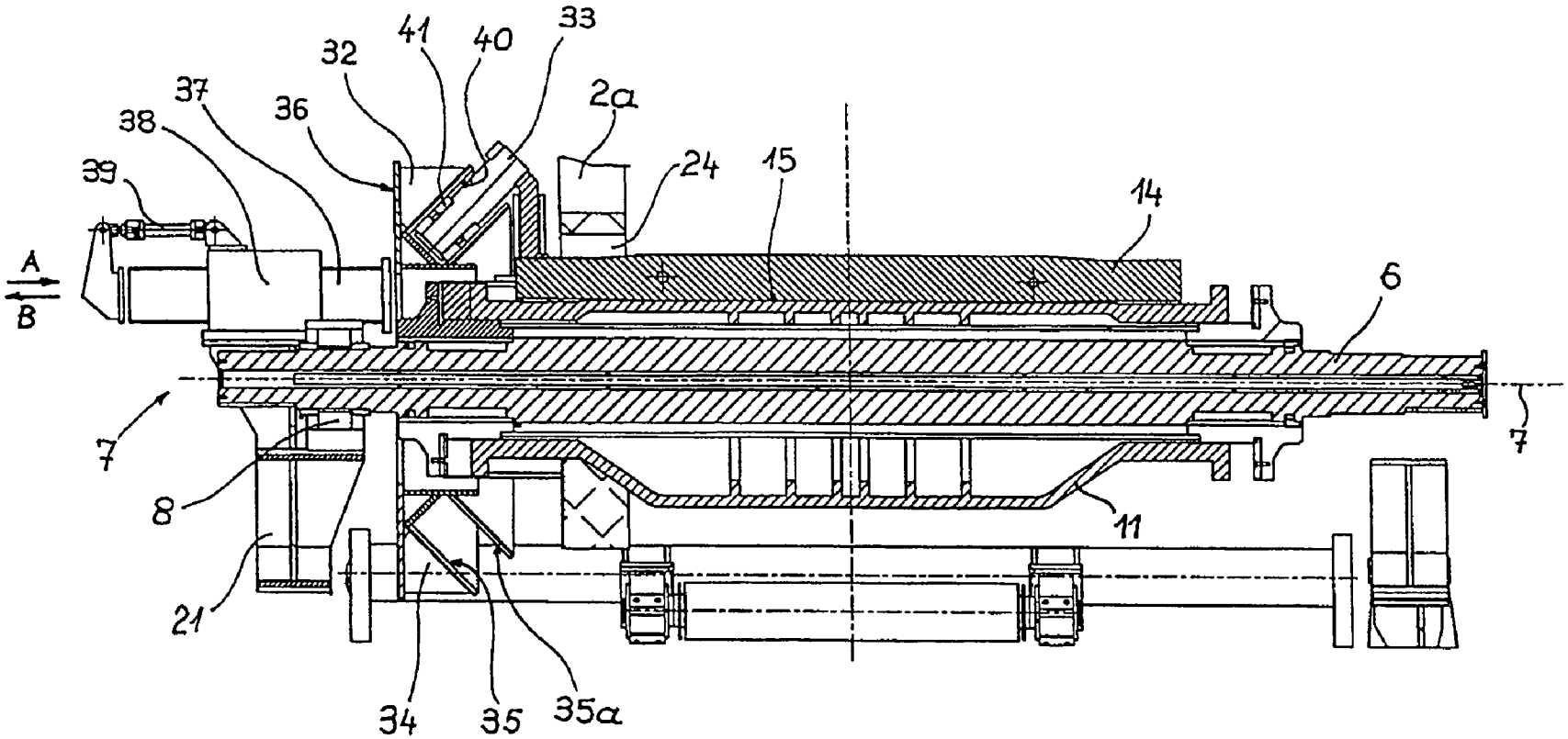
FIG. 2 shows a longitudinal section through the strip reeling device according to a first embodiment of the invention.
Figure 3:
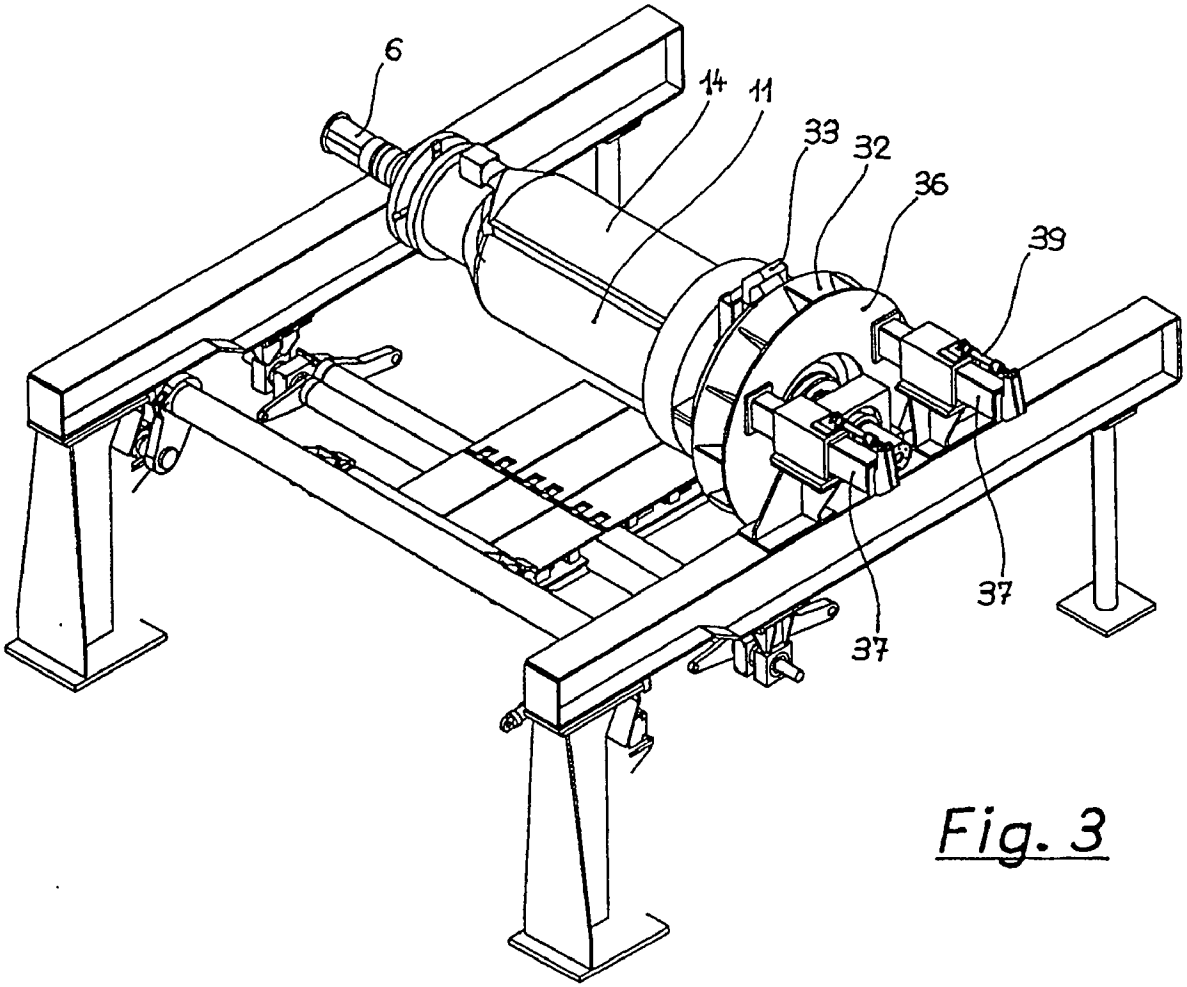
FIG. 3 shows an oblique view of the strip reeling device supported on a carrying frame, according to the first embodiment of the invention.

In FIGS. 2 and 3, to achieve greater clarity, the actuating device 17 according to the invention between the reel shaft 6 and the stirrup clamp 14, the supporting bearing 8 for the rotational support of the reel drum 6 and the furnace wall 2*a* with the disk 24 are illustrated in only one half of the figure. In principle, of course, it is necessary to have a symmetrical support of the reel shaft and of the stirrup clamp on both sides.

As may be gathered from FIG. 2, the strip reeling device 4 comprises the reel shaft 6 on which the reel drum 11 is arranged fixedly in terms of rotation. These components are assigned internal cooling by means of coolant feed lines and coolant discharge lines through the central reel shaft.

Figure 4:
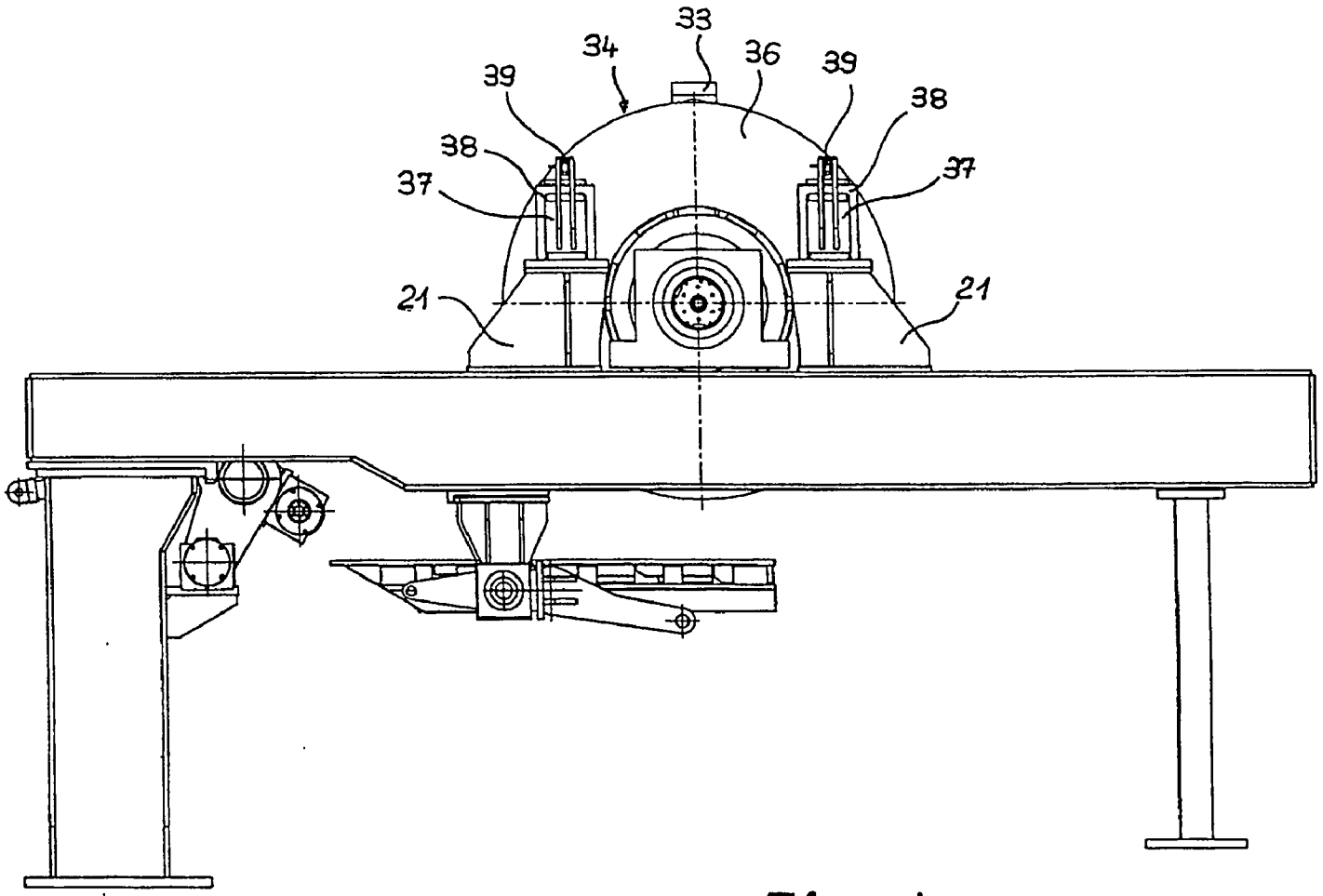
FIG. 4 shows an end view of the connection element with the distribution of three displacement rams, according to the first embodiment of the invention.

The actuating device 17 is formed by an adjusting frame 32 and a link 33. The adjusting frame 32 comprises a disk-shaped basic element 34 having guides 35, 35*a* which are in the form of a funnel wall and which together form an annular reception space for the link 33. The disk-shaped basic element 34 has, arranged centrally, a passage orifice for the reel shaft 6. One side of the basic element 34 is formed by a bottom plate 36, to which a plurality of displacement rams 37 are welded (FIG. 4), in order to achieve a uniform adjustment of the basic element. These are mounted in guide frames 38 of a stationary carrying frame 21 so as to be displaceable parallel to the direction of the axis of rotation 7 of the reel shaft 6. Articulated on each displacement ram 37 is a pressure medium cylinder 39 which is supported on the guide frame 38 of the stationary carrying frame 21. The link 33 has counterstays 40 formed by rollers 41 which roll on one of the guides 35, 35*a*, depending on the loading direction A, B of the pressure medium cylinder 39.

In order to achieve an opening of the gap 15 for receiving the strip head, the pressure medium cylinder 39 is loaded such that the displacement ram 37 is moved in the direction of the arrow B. This results necessarily in a radial outward movement of the link 33, with the result that the stirrup clamp 14 is also moved outward with the effect of enlarging the gap. If a clamping of the strip head after it enters the gap 15 is to be achieved, a loading of the pressure medium cylinder 39 takes place such that the displacement ram 37 is moved in the direction of the arrow A. This results necessarily in a radial inward movement of the link 33, with the result that the stirrup clamp 14 is also moved inward.

Figure 5:
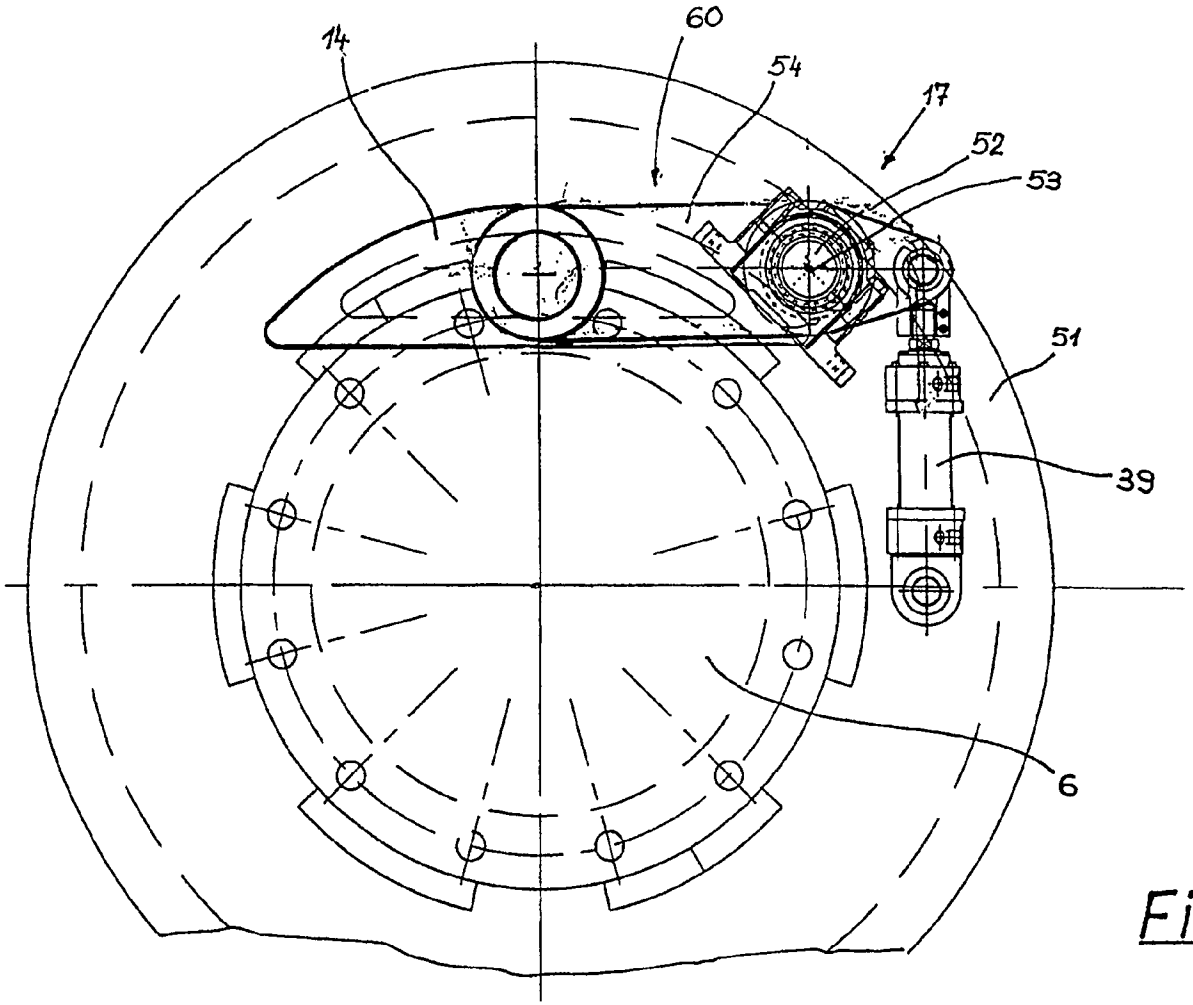
FIG. 5 shows the illustration of a connection element according to a second embodiment of the invention.

FIG. 5 illustrates diagrammatically a further embodiment of an actuating device 17 for positioning a stirrup clamp 14 in relation to the reel drum. The actuating device 17 comprises a carrying frame 51 supported fixedly in terms of rotation on the reel shaft 6 and on which a pivot pin 52 with a pivot axis 53 is secured. A pivoting mechanism 60 is formed by a two-armed lever 54 and is arranged pivotably on the pivot pin 52. A pressure medium cylinder 39 engages in an articulated manner on a lever arm of the lever 54 and, in turn, is supported in an articulated manner on the carrying frame 51. The stirrup clamp 14 is articulated on the other lever arm of the two-armed lever 54 and, under the action of the pressure medium cylinder, executes a predetermined pivoting movement through a small pivot angle.

Figure 6:
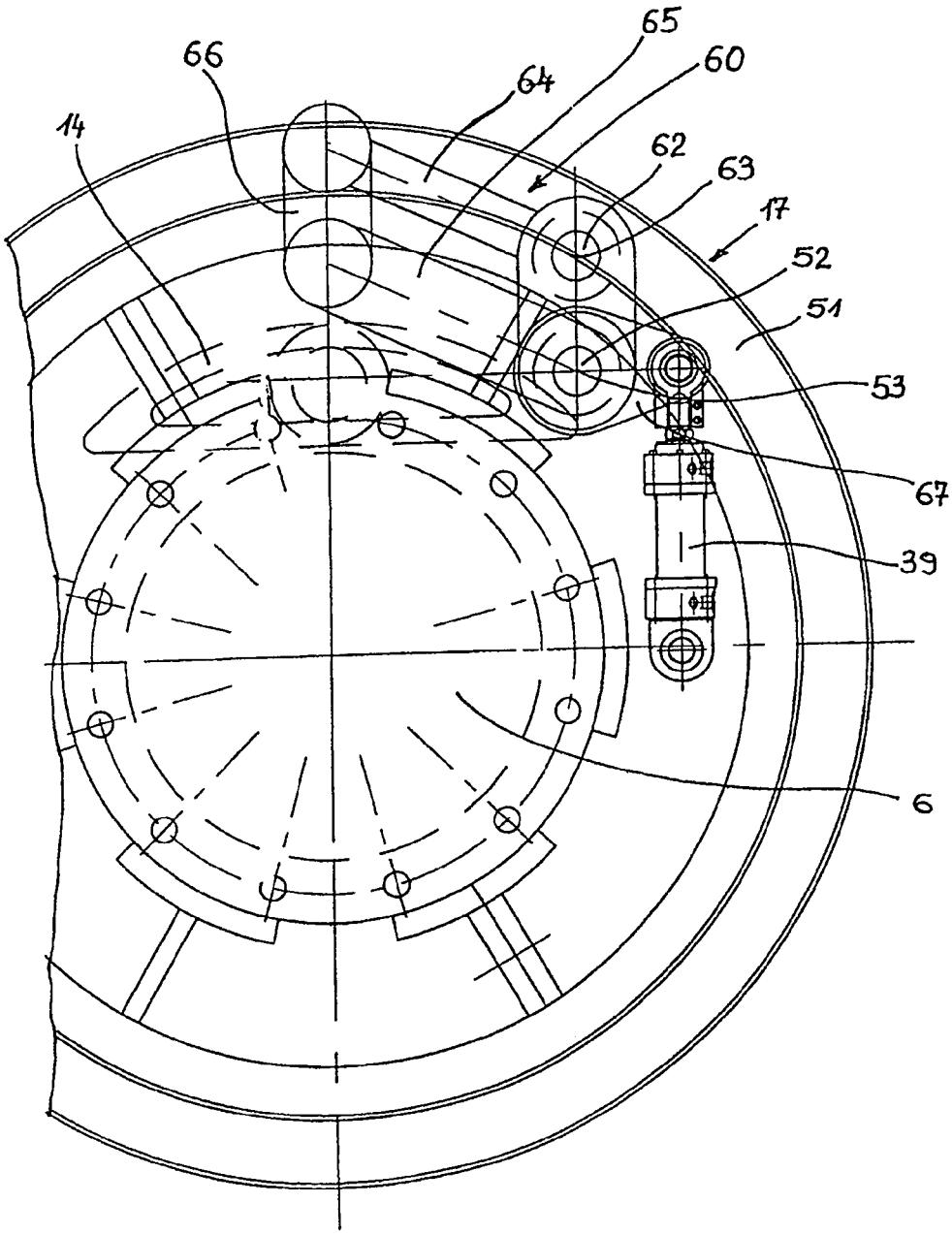
FIG. 6 shows the illustration of a connection element according to a third embodiment of the invention.

FIG. 6 illustrates diagrammatically a further embodiment of an actuating device 17 for positioning a stirrup clamp 14 in relation to the reel drum. The actuating device 17 comprises a carrying frame 51 supported fixedly in terms of rotation on the reel shaft 6 and on which two pivot pins 52, 62 with a pivot axis 53, 63 are secured. A parallel link system formed by the links 64, 65, 66 allows a parallel displacement of the stirrup clamp 14 articulated on the link 65 under the action of the pressure medium cylinder 39.

The invention claimed is:

1. A metal strip reeling device for a reel furnace, the strip reeling device comprising:

a reel shaft, a reel drum supported on the reel shaft, the reel shaft passing through a furnace wall and delimiting an inner space of the reel furnace;

supporting bearings rotatable supporting the reel shaft, a connection element positioning at least one stirrup clamp and the reel drum with respect to one another;

a gap for receiving a strip head being set between the reel drum and the at least one stirrup clamp, wherein the reel drum is a closed body and the connection element is an actuating device operable for fixing a specific gap width between the reel drum and the at least one stirrup clamp such that the wheel drum contacts one surface of the strip head and the stirrup clamp contacts an opposite surface of the strip head for clamping the strip head which has entered the gap.

2. The reeling device of claim 1, wherein the supporting bearings for the shaft are outside the reel furnace.

3. The reeling device as claimed in claim 2, wherein the reel shaft and the stirrup clamp pass through the furnace wall delimiting the inner space of the reel furnace, and the actuating device is arranged outside the inner space of the reel furnace.

4. The reeling device as claimed in claim 3, wherein the furnace wall comprises a disk, the disk co-rotating with the reel shaft in a passage region of the reel shaft and the stirrup clamp.

5. The reel furnace as claimed in claim 1, wherein the actuating device comprises:

a carrying frame with guides, the carrying frame being fixed on the reel shaft to rotate therewith; and a link carrying the stirrup clamp and having counterstays which are guided on the guides of the carrying frame, the guides and the counterstays allowing relative movement for varying the gap width of the gap between the stirrup clamp and the reel drum.

6. The reel furnace as claimed in claim 1, wherein the actuating devices comprises:

an adjusting frame with guides and a link which is relatively movable with respect to the adjusting frame and carries the stirrup clamp and the adjusting frame has counterstays, a fixed supporting structure on which the adjusting frame is supported displaceably, and a further actuating member engages on the adjusting frame and, is supported on the fixed supporting structure.

7. The reel furnace as claimed in claim 6, wherein the adjusting frame is supported on the fixed supporting structure to be relatively movable parallel to an axis of rotation of the reel shaft and is acted upon by the actuating member, and the guides on the adjusting frame and the counterstays on the link are oriented at an angle to the axis of rotation of the reel shaft.

8. The reeling device of claim 6, wherein the further actuating member is a hydraulic pressure medium cylinder.

9. The reel furnace as claimed in claim 5, wherein the carrying frame and the counterstays on the link are oriented radially with respect to an axis of rotation of the reel shaft.

10. The reel furnace as claimed in claim 1, wherein the actuating device comprises:

a carrying frame fixed to the reel shaft to rotate therewith, the carrying frame has a pivot axis oriented parallel to the axis of rotation of the reel shaft, a pivoting mechanism is arranged pivotably on the pivot axis and is coupled along one extent to the stirrup clamp and along another extent to another actuating member which is supported on the carrying frame.

11. The reel furnace as claimed in claim 10, wherein the pivoting mechanism is formed by a two-armed lever.

12. The reel furnace as claimed in claim 10, wherein the pivoting mechanism comprises a parallel link arrangement for tying up the stirrup clamp.

13. The reel furnace as claimed in claim 1, wherein the actuating member comprises a pressure medium cylinder and a control block for the pressure medium cylinder and incorporated into a plant control loop.

14. A reel furnace having a strip reeling device as claimed in claim 1, the furnace having an inner space and the reeling device being arranged essentially in the inner space of the reel furnace, wherein the furnace is operable for reversing hot rolling of a metal strip.

15. The reel furnace as claimed in claim 4, wherein a carrying frame is fastened to the co-rotating disk of the furnace wall or is integrated into the furnace wall.

* * * * *